US006363854B1

(12) United States Patent
Schweitzer

(10) Patent No.: US 6,363,854 B1
(45) Date of Patent: Apr. 2, 2002

(54) MINE ALTERABLE FROM AN ARMED STATE TO A SAFE STATE

(76) Inventor: Peter Schweitzer, 50 Spruce Ter., Wayne, NJ (US) 07470

( * ) Notice: Subject to any disclaimer, the term of this patent is extended or adjusted under 35 U.S.C. 154(b) by 0 days.

(21) Appl. No.: 09/578,096

(22) Filed: May 25, 2000

(51) Int. Cl.[7] ..... F42B 23/00
(52) U.S. Cl. ..... 102/401; 102/426
(58) Field of Search ..... 102/401, 404, 102/406, 426, 428

(56) References Cited

U.S. PATENT DOCUMENTS 3,115,834 A * 12/1963 Schwarz et al.
3,447,461 A * 6/1969 Lapof ..... 102/8
3,667,387 A * 6/1972 Picard et al. ..... 102/8
4,058,061 A * 11/1977 Mansur, Jr. et al. ..... 102/8
4,712,480 A * 12/1987 Lindstadt et al. ..... 102/427
4,854,239 A * 8/1989 Van Sloun ..... 102/426
5,511,482 A * 4/1996 DiPietropolo ..... 102/426
6,112,668 A * 9/2000 Woodall et al. ..... 102/417

* cited by examiner

*Primary Examiner*—Charles T. Jordan
*Assistant Examiner*—Kimberly S. Smith
(74) *Attorney, Agent, or Firm*—Thomas L. Adams

(57) ABSTRACT

A mine has the ability to change from an armed state to a safe state without touching of the mine. The mine includes a case and an explosive charge in the case. Also included is a detonator located adjacent to the explosive charge. The firing of the detonator can set off an explosive chain for exploding the explosive charge. A movable firing pin in the case can strike and fire the detonator in response to pressure directed toward the case. The mine also includes a blocking member adapted to move from a retracted position to a blocking position between the detonator and the firing pin in order to prevent firing of the detonator by the firing pin. Also included is a driver for moving the blocking member from the retracted position to the blocking position without manual touching of the case.

19 Claims, 5 Drawing Sheets

MINE ALTERABLE FROM AN ARMED STATE TO A SAFE STATE

BACKGROUND OF THE INVENTION

1. Field of the Invention

The present invention relates to mines, and in particular to devices for disabling a mine.

2. Description of Related Art

Land mines are still considered a necessary part of warfare. Of course, a lingering problem is finding, and disabling or destroying the land mines after hostilities cease. While combatants may try to make maps indicating locations of land mines, these maps are often hastily made and inaccurate, or are lost in the destruction that is part of armed conflict. Oftentimes, there is simply not the resources available to devote the time needed for carefully tracking down, and extracting or detonating these mines.

In U.S. Pat. No. 5,415,103 an interrogation unit can program a land mine to set the conditions under which the land mine will detonate. The specification states that "remote communication may be performed with certain lines for activation and deactivation." Column 1, lines 16–17. The electrical firing circuit of U.S. Pat. No. 5,218,574 provides several operating modes for a land mine. In one mode, an electrolytic timing device can detonate the land mine after a predetermined delay.

These references do not disclose any mechanisms for disabling a land mine. While electronics can be fabricated to perform a variety of sophisticated functions, the mechanical process of disabling the mine is extremely important. This mechanism must be highly reliable so that it does not run the risk of detonating the mine before it is placed. On the other hand, a mechanism must also be designed to (a) avoid premature disabling, and (b) reliably disable a mine when appropriate. Because of the dangerous nature of a mine, the mechanism must be made relatively simple and must have mechanisms that are unlikely to bind, jam, or otherwise fail.

In U.S. Pat. No. 4,856,431 a directional mine is armed by inserting firing unit 6, which is locked into place by pin 15. The mine can be detonated by firing the igniter 11. After a pre-programmed amount of time, however, an electromagnet retracts pin 15 to eject unit 17, thereby disarming the mine. This reference is relatively complicated and does not show a movable element that is inserted into a blocking position to disable a land mine after it is armed.

In U.S. Pat. No. 4,712,478 slider 30 has a passage that moves into position just before detonation to create a firing path. The land mine can be neutralized by an undefined circuit that fires detonator 44 before slider 30 is in the armed position. Alternatively, the battery that operates circuit 10 can run down and disable the land mine. This reference does not disclose a blocking element that is inserted into a blocking position to disable the land mine after it is armed.

In U.S. Pat. No. 4,854,239 a munition is fired by two explosively powered pistons if they are fired in a proper sequence before a third piston is fired. Premature firing of the third piston will fracture a component, which is then elevated to indicate the munition is disabled. Again, this complicated reference does not show a blocking element for disabling a land mine after it is armed.

See also U.S. Pat. Nos. 3,667,387 and 3,994,227.

Accordingly, there is a need for a mechanism for disabling a mine in a simple and highly reliable fashion.

SUMMARY OF THE INVENTION

In accordance with the illustrative embodiments demonstrating features and advantages of the present invention, there is provided a mine having the ability to change from an armed state to a safe state without touching of the mine. The mine includes a case and an explosive charge in the case. Also included is a detonator located adjacent to the explosive charge. The firing of the detonator can set off an explosive chain for exploding the explosive charge. The mine includes a movable firing pin mounted in the case for striking and firing the detonator in response to pressure directed toward the case. The mine also includes a blocking member adapted to move from a retracted position to a blocking position between the detonator and the firing pin in order to prevent firing of the detonator by the firing pin. Also included is a driver for moving the blocking member from the retracted position to the blocking position without manual touching of the case.

By employing the foregoing principles, an improved mine is achieved. In a preferred embodiment, a blocking member is slidably mounted in a mine and can move into a position between a firing pin and detonator to disable the mine. In one embodiment an electromagnet is energized with a polarity to repel a permanently magnetized element. If the electromagnet is disabled, the permanently magnetized element is drawn to the electromagnet to pull a flexible foam member in position between the firing pin and detonator.

This electromagnet can be disabled in a variety of ways. A circuit driving the electromagnet can have a timer that interrupts current to the electromagnet after a predetermined delay interval. Alternatively, a battery powering the electromagnet can simply run down. In some embodiments a radio receiver can detect and decode an encrypted command signal and then fire a firing cap to explode the mine.

In other embodiments, a spring loaded plunger can be biased to thrust a blocking member between the firing pin and detonator. A solenoid-like electromagnet, when energized, can pull the plunger and retract the blocking member to arm the mine. Again, interruption of the drive to the electromagnet will cause the blocking member to be thrust between the firing pin and detonator. In still other embodiments, a catch can hold a spring biased plunger in place until released by a separate releasing device.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
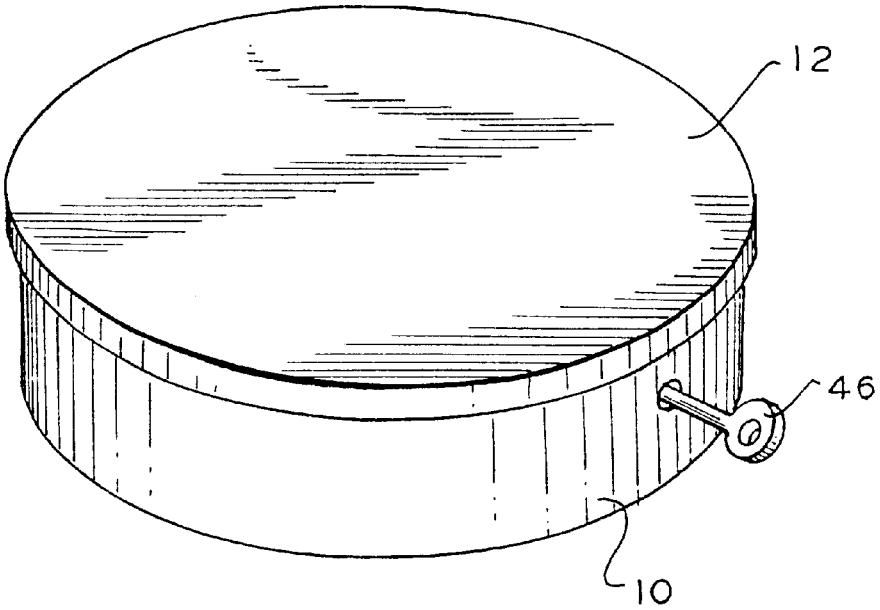
FIG. 1 is perspective view of a mine in accordance with principles of the present invention.

Referring to FIGS. 1–5, a case is shown with a hollow cylindrical housing 10 covered by a vertically reciprocatable cap 12. Cap 12 is a circular disk with a dependent cylindrical apron 14. A plunger 16 mounted concentrically on the underside of cap 12 and extends through a concentric hole 18 atop housing 10.

A concentric cylindrical wall 20 is attached to the ceiling inside housing 10. Fitted within an annular groove on the inside of wall 20 is a domed snap ring 22. A firing pin 24 is shown attached concentrically in snap ring 22. External pressure applied to cap 12 causes plunger 16 to descend and press against firing pin 24. Eventually, snap ring 22 inverts its shape from upwardly convex (illustrated condition) to upwardly concave. The sudden change in shape drives firing pin 24 against concentrically-located detonator 26. Detonator 26 is located above booster 28, which is located on the floor of housing 10.

The space inside housing 10 and outside wall 20 is filled with an explosive charge 30. Charge 30 has essentially a cylindrical inner and outer surface and a flat bottom. The top of the explosive charge 30 is flat as well, except for a recess 32 containing components to be described presently. While recess 32 is shown as a pie-shaped sector with radially aligned side walls, in other embodiments a different shape can be used instead.

In this embodiment a blocking member is shown as a D-shaped, flexible material 34 made, for example from polyurethane foam. Member 34 is shown attached inside the curve of a C-shaped magnetized element 36. Element 36 may be a horseshoe-type permanent magnet, although other types of magnets may be used instead. Blocking member 34/36 is slidably mounted atop shelf 38 and may be guided by appropriate guiding rails, guiding pins and the like (such guiding means not shown).

A driver is shown herein as an electromagnetic device in the form of a C-shaped magnetic core 40 encircled at its midsection by an electrical coil 42. The driver also includes a circuit contained in a subsystem 44 for driving the electrical coil 42 through wires 45. As described further hereinafter, subsystem 44 can have a timing means for controlling the time over which coil 42 is energized. Subsystem 44 will also include a battery for powering its internal circuit and the external coil 42.

Figure 3:
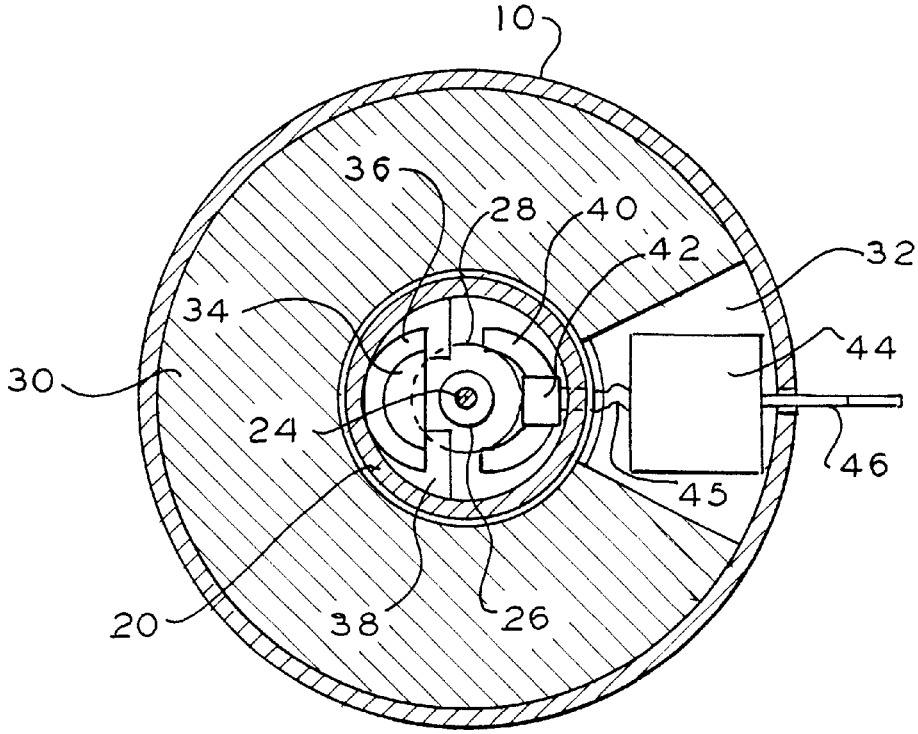
FIG. 3 is a cross-sectional, plan view taken along line 3—3 of FIG. 1.
Figure 4:
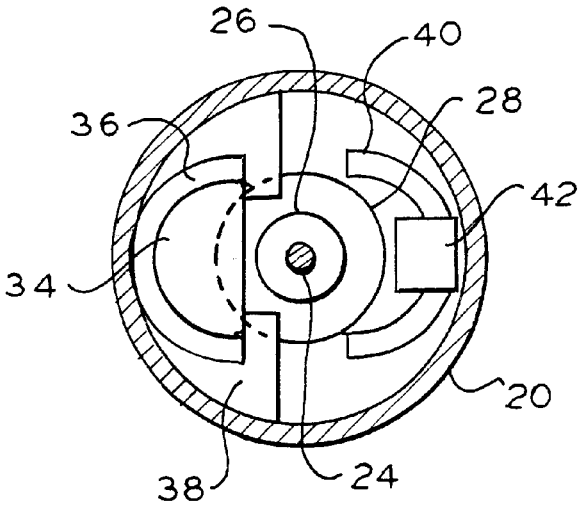
FIG. 4 is a detailed view of the electromagnet mechanism of FIG. 3.

Essentially, the circuit in subsystem 44 can use coil 42 to magnetize core 40 and repel magnetized element 36 to drive it to the position shown in FIGS. 3 and 4. When coil 42 is not energized, core 40 does not apply a repulsive force and therefore, magnetized element 36 is attracted to core 40 and moves from the position shown in FIG. 4 to the position shown in FIG. 5, under circumstances to be described presently.

Subsystem 44 is shown with an antenna 47 projecting through an opening in the top of housing 10. Antenna 47 lies primarily in a horizontal plane underneath cap 12. A firing cap 49 is also shown occupying a cavity in charge 30. Firing cap 49 connects to subsystem 44 and can be triggered under the circumstances described hereinafter. Subsystem 44 is shown with a key 46 acting as a manually operable projection for arming the mine in a manner to be described presently.

Figure 6:
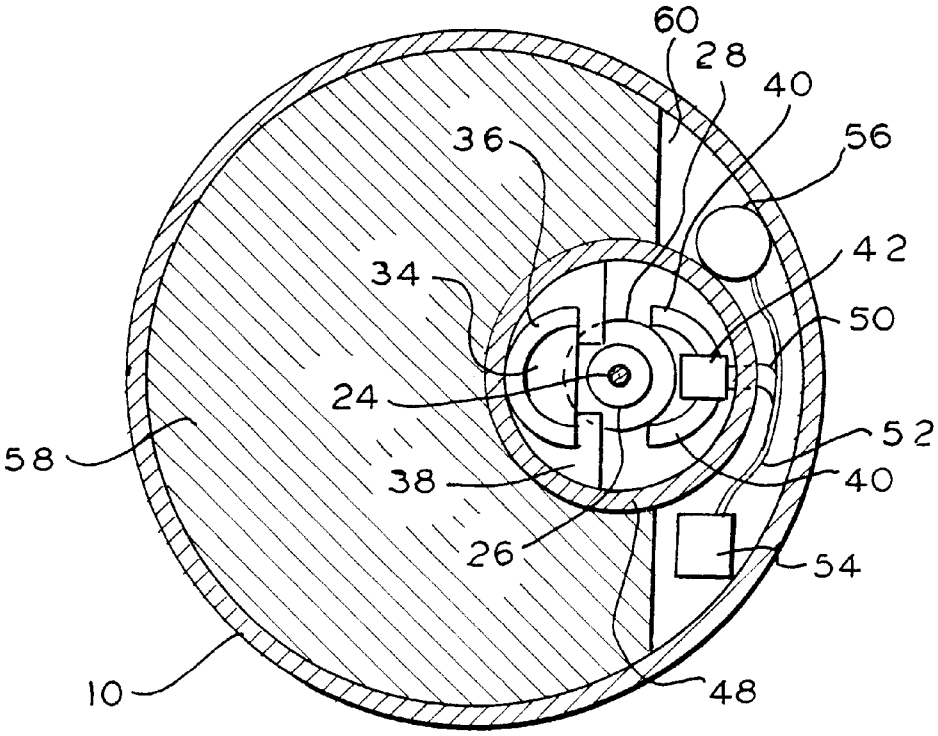
FIG. 6 is a cross-sectional, plan view of a mine that is an alternate to that shown in FIG. 3.

Referring to FIG. 6, previously mentioned housing 10 is shown with an internal cylindrical wall 48 that is similar to previously mentioned wall 20, except that wall 48 is positioned in an off-centered location. Located inside wall 48 are components identical to those previously described in connection with FIGS. 2 and 3, and therefore these identical components bear reference numerals identical to those used previously. A pair of wires 50 is connected through cable 52 to a subsystem 54 that is identical to previously mentioned subsystem 44 (FIG. 2 and 3), except for the use of an external battery 56, in contrast to the internal battery used in subsystem 44.

In this embodiment explosive charge 58 is more compact and is essentially cylindrical except for the sector 60 and the volume occupied by walls 48.

Figure 2:
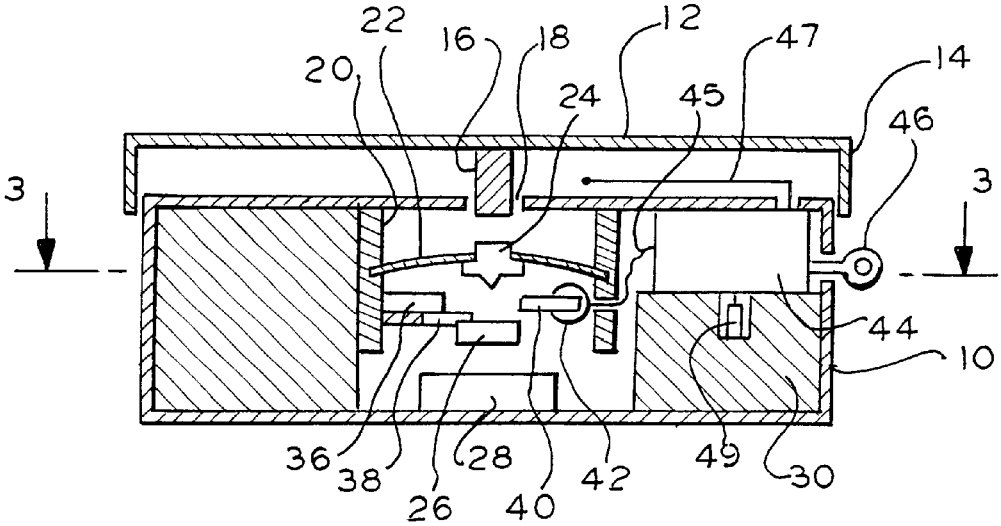
FIG. 2 is a cross-sectional, elevational view of the mine of FIG. 1.
Figure 7:
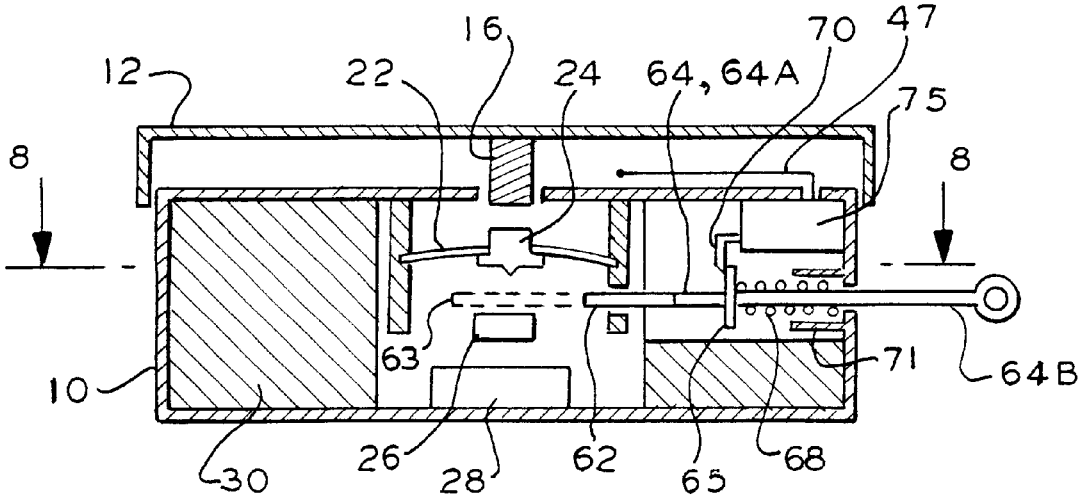
FIG. 7 is a cross-sectional, elevational view of a mine that is an alternate to that shown in FIG. 2.
Figure 8:
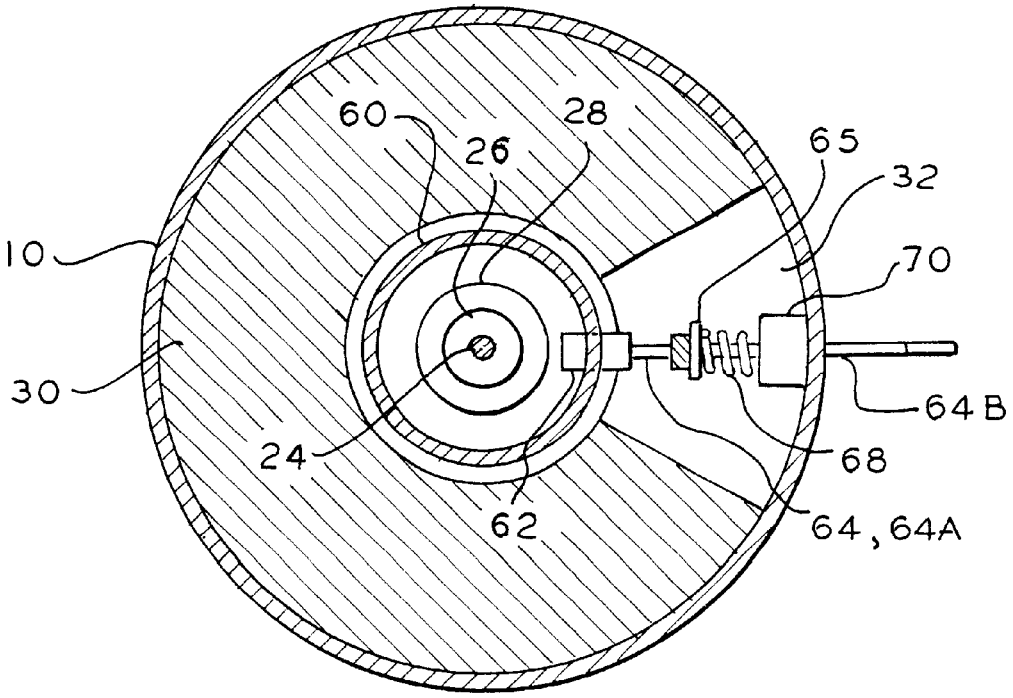
FIG. 8 is a cross-sectional, plan view taken along line 8—8 of FIG. 7.
Figure 9:
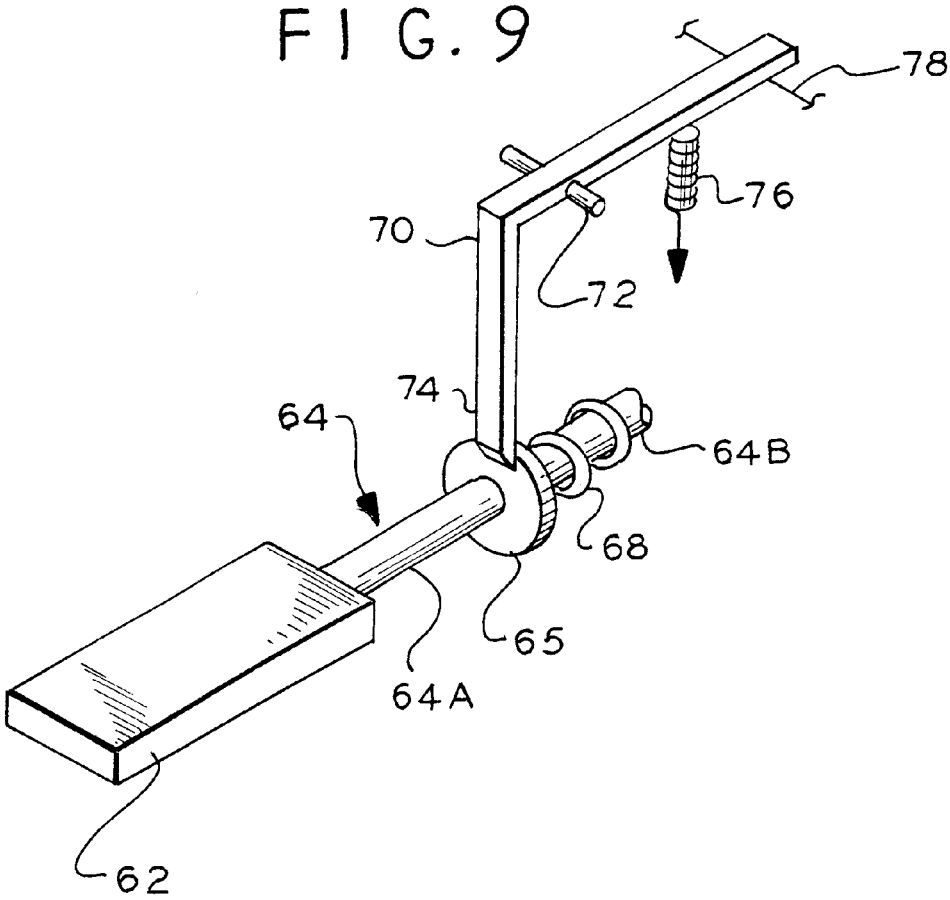
FIG. 9 is a detailed view of the blocking mechanism of FIGS. 7 and 8.

Referring to FIGS. 7, 8 and 9, housing 10 contains an explosive charge 30 identical to that shown in FIGS. 2 and 3. Consequently, charge 30 has an identical recess 32. Cylindrical walls 60 are concentrically located inside housing 10 and circumscribe previously mentioned booster 28, detonator 26 and firing pin 24, which are all located in the same position as previously described.

An alternate blocking member is shown as a paddle 62 made of a flexible material such as a plastic foam, and is attached to the end of shaft 64. Shaft 64 has a central flange 65 separating distal end 64A from proximal end 64B. Proximal end 64B is encircled by a compression spring 68 acting as a bias member that is part of a driver. Spring 68 together with shaft 64 slidably fit in a socket 71 mounted on an inside wall of housing 10. Proximal end 64B extends outside housing 10 to form a manually operable projection that can be manipulated for the reasons to be described presently.

A releaseable catch is shown as an L-shaped bar 70 pivotally mounted on trunnions 72. The end 74 of bar 70 is shown engaging the distal face of flange 65. The opposite end of bar 70 is shown attached to a tension spring 76 tending to rotate bar 70 and release end 74 from flange 65. This releasing motion of bar 74 is restrained by fuse wire 78 which prevents spring 76 from causing rotation of bar 70 beyond the position shown in FIG. 9, but does allow rotation in opposition to spring 76. As described further hereinafter, a pulse of current applied to fuse wire 78 will rupture the wire, thereby enabling tension spring 76 to rotate bar 70 and move end 74 away from flange 65.

A subsystem 75 (FIG. 7) is shown mounted above shaft 64 to rotatably fin support previously mentioned bar 70. Subsystem 75 also contains the previously mentioned circuit, including a battery and an optional timing means. Previously mentioned antenna 47 is shown connected to subsystem 75 through an upper opening in housing 10.

Figure 10:
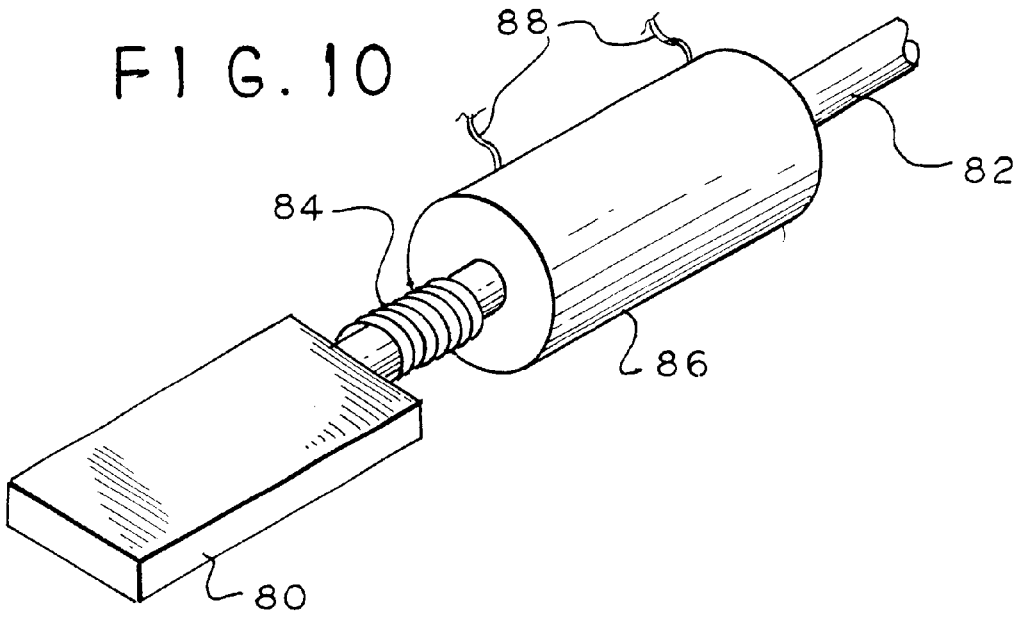
FIG. 10 is a detailed view of a blocking mechanism that is an alternate to that of FIG. 9.

Referring to FIG. 10, an alternate driver is shown with a paddle 80 made of a flexible material such as a plastic foam, and attached to a shaft 82. Shaft 82 is slidably mounted inside solenoid coil 86. Compression spring 84 encircles shaft 82 between paddle 80 and solenoid coil 86 in order to urge shaft 82 out of coil 86. Solenoid coil 86 is an electromagnetic device that can be energized through wires 88 to magnetically attract and pull shaft 82 into the position shown in FIG. 10, thereby compressing spring 84. To facilitate the magnetic attraction, shaft 82 may be made of two parts with the portion to the right made of plastic or other non-magnetic material so that the bulk of the ferromagnetic material is contained inside solenoid coil 86 when energized as shown in FIG. 10.

Figure 11:
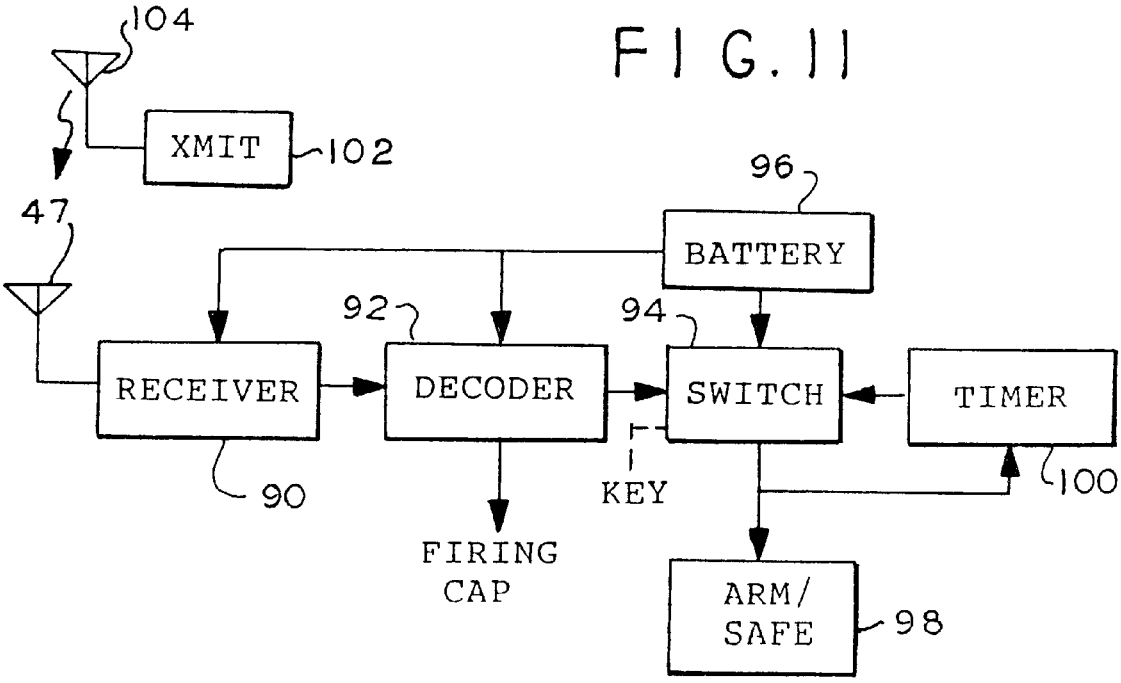
FIG. 11 is a schematic block diagram of a receiver that may be employed in the foregoing embodiments.

Referring to FIG. 11, radio receiver 90 detects a radio signal from antenna 47 and applies the detected signal to decoder 92. Receiver 90 can detect AM or FM signals modulated in a variety of fashions, especially pulse code modulation. The signal from receiver 90 is a series of encrypted bits that are sent to decoder 92 for decoding. If a self-destruct code is received, decoder 92 sends a signal to a firing cap, for example cap 49 of FIG. 2. If a disable code is received, decoder 92 operates switch 94 to disconnect battery 96 from device 98. Device 98 may be coil 42 of FIG. 3, fuse wire 78 of FIG. 9, or solenoid coil 86 of FIG. 10.

The system of FIG. 11 can also disable itself through a timing means 100. This timer 100 may be a clock driving a counter until a predetermined count is reached, at which time switch 94 is operated. Alternatively, a charging device can be slowly charged until it reaches a threshold voltage, at which time switch 94 may be operated. In all of these arrangements, battery 96 will have a limited life. When battery 96 runs down, power can no longer be supplied through switch 94 to device 98. With the schemes described above (except for FIG. 9), the absence of power will result in disabling of the mine. Furthermore, the previously mentioned key (for example key 46 of FIG. 1) can be manipulated to set the state of switch 94.

To facilitate an understanding of the principles associated with the foregoing apparatus, its operation will be briefly described in connection with the embodiment of FIGS. 1–5 and 11. When the mine is shipped from the factory blocking member 34 is in the position shown in FIG. 5. When the mine is placed in the field, key 46 is manipulated to close switch 94 (FIG. 11). Consequently, coil 42 is energized to produce a magnetic force that repels magnetized element 36. As a result, element 36 is driven away to the position shown in FIG. 4.

This resulting condition shown in FIGS. 2 and 3 arms the mine. Consequently, pressure applied to cap 12 can depress plunger 16 to push firing pin 24. If pushed sufficiently, domed ring 22 will invert and snap firing pin 24 down against detonator 26. Consequently, detonator 26 will start off an explosive chain, and will fire booster 28. Booster 28 will fire explosive charge 30 to complete the explosion.

Figure 5:
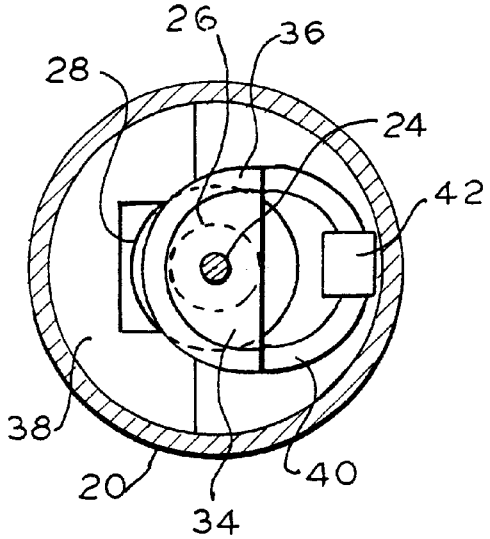
FIG. 5 is a detailed view of the mechanism of FIG. 4 with the magnetized element drawn to the electromagnet.

The mine can however, be disabled. In the simplest case, battery 96 (FIG. 11) in subsystem 44 (FIGS. 2 and 3) can run down. As a result, current no longer flows through wire 45, so that coil 42 is disabled. Consequently, no magnetic repulsive forces are generated through core 40. In response, magnetized element 36 is now attracted to core 40 and will move from the position shown in FIG. 4 to that shown in FIG. 5. Once positioned as shown in FIG. 5, firing pin 24 is isolated from detonator 26. Therefore, even if cap 12 is depressed and firing pin 24 descends, it strikes foam material 34 without further effect.

In some cases field personnel may wish to disable the mine before the battery runs down. In this case transmitter 102 (FIG. 11) can send an encoded signal over antenna 104, which is received by antenna 47 and detected by receiver 90. Depending upon the transmitted code, decoder 92 can either issue a signal to fire the firing cap or can operate switch 94. If switch 94 is operated, then battery 96 can no longer supply current to device 98, which is in this embodiment, coil 42. Therefore blocking element 34 will return to the position shown in FIG. 5 for the reasons previously given.

Alternatively, the closure of switch 94 (FIG. 11) can supply power to timer 100. After a predetermined time elapses, timer 100 provides an overriding signal to open switch 94 and disable device 98 to bring about the condition shown in FIG. 5.

It will be appreciated that the embodiment of FIG. 6 will operate in substantially the same fashion, except that the explosive chain will start from an offcenter position.

Also, the embodiment of FIGS. 7–9 will operate in a similar fashion with some exceptions. The mine will be shipped from the factory with the blocking member 62 in the position 63 shown in phantom in FIG. 7. When placed in the field, the operator will withdraw the exposed end 64B of shaft 64 to bring blocking member 62 to the position shown in full in FIG. 7. To accomplish this, flange 65 will push, lift, and pass the beveled face of bar end 74. To do this, bar 70 will rotate about trunnions 72 to stretch tension spring 76 and lift bar 70 off fuse wire 78.

Once flange 65 passes bar end 74, tension spring 76 rotates bar 70 back to rest on fuse wire 78. This produces the condition shown in FIG. 9 where spring 68 pushes flange 65 against bar end 74. Bar end 74 continues to fly restrain flange 65 and shaft 64 since bar 70 cannot rotate past fuse wire 78.

In this embodiment, current must be supplied through fuse wire 78 (FIG. 9) in order to release shaft 64 and blocking member 62. Accordingly, this embodiment requires a source of electrical current in order to disable the mine. An arrangement of this type may be appropriate where a high-energy electromagnetic pulse is issued near the mine.

For the embodiment of FIG. 10, the circuit of FIG. 11 will operate in the above described manner to supply or remove current from wires 88. Upon removal of current from wires 88, blocking member 80 will be deployed to prevent firing pin 24 from reaching detonator 26 (FIG. 7).

It is appreciated that various modifications may be implemented with respect to the above described, preferred embodiment. For example, the mine need not have a circular perimeter and may have a perimeter that is square, rectangular, polygonal, elliptical or shaped otherwise. While the blocking member is shown having a rectangular shape, in other embodiments this member can be cylindrical or shaped otherwise. This member may in some cases be formed from a number of separate components. Also a variety of firing pins can be used that are positioned in a number of different locations and supported by a variety of mechanisms. Furthermore, the blocking member can be moved by a variety of mechanisms deriving energy from sources such as torsion springs, elastomers, gravity, electrical charges, magnetic fields, etc. Moreover, the blocking member need not slide linearly, and may rotate or follow a curved path, in other embodiments. In addition, the disclosed electrical circuit can be modified to include fewer or more features and may be fabricated from discrete electrical components, integrated circuits, etc. Also, the various components can have different sizes and shapes depending upon the desired volume, strength, thermal stability, etc.

Obviously, many modifications and variations of the present invention are possible in light of the above teachings. It is therefore to be understood that within the scope of the appended claims, the invention may be practiced otherwise than as specifically described.

What is claimed is:

1. A mine having the ability to change from an armed state to a safe state without touching of the mine, the mine comprising:

a case;

an explosive charge in said case;

a detonator located adjacent to said explosive charge, wherein firing detonator sets off an explosive chain for exploding said explosive charge;

a movable firing pin mounted in said case for striking and firing said detonator in response to pressure directed toward said case;

a blocking member adapted to move from a retracted position to a blocking position between said detonator and said firing pin in order to prevent firing of said detonator by said firing pin; and a driver for moving said blocking member from said retracted position to said blocking position without manual touching of said case.

2. A mine according to claim 1 wherein said blocking member includes a flexible material for isolating said detonator from said firing pin and cushioning any impact of said firing pin on said blocking member.

3. A mine according to claim 1 wherein said explosive charge has an annular shape with a recess, said driver being located at least partially in the recess in said explosive charge.

4. A mine according to claim 1 wherein said driver and said blocking member comprise:

an electromagnetic device; and a circuit connected to said electromagnetic device for driving said electromagnetic device to produce an electromagnetic force.

5. A mine according to claim 4 wherein said circuit comprises:

timing means for interrupting said circuit and the electromagnetic force from said electromagnetic device in order to move said blocking member to said blocking position.

6. A mine according to claim 5 wherein said timing means comprises:

a battery sized to rundown within a predetermined time in order to disable said circuit.

7. A mine according to claim 4 wherein blocking member comprises:

a magnetized element polarized to be attracted to said electromagnetic device in order to bring together said magnetized element and said electromagnetic device, said electromagnetic device being polarized to produce an electromagnetic force for repelling said magnetized element.

8. A mine according to claim 7 wherein said magnetized element comprises a flexible material for cushioning any impact of said firing pin; and said electromagnetic device being stationary within said case.

9. A mine according to claim 8 wherein said electromagnetic device comprises a U-shaped core, and said magnetized element being U-shaped to straddle said flexible material.

10. A mine according to claim 1 wherein said driver comprises:

a bias member for urging said blocking member from said retracted position to said blocking position.

11. A mine according to claim 10 wherein said driver comprises:

an electromagnetic device for moving said blocking member in opposition to said bias member.

12. A mine according to claim 10 wherein said driver comprises:

a releasable catch for holding said blocking member in said blocking position in opposition to said bias member.

13. A mine according to claim 1 wherein said driver comprises:

a remotely controlled receiver for actuating said driver and moving said blocking member to said blocking position.

14. A mine according to claim 13 wherein said receiver comprises:

a decoding means for decoding a detected radio signal.

15. A mine according to claim 14 wherein said case comprises:

a housing; and a cap mounted to reciprocate on said housing, said receiver including an antenna mounted under said cap.

16. A mine according to claim 1 wherein said firing pin is located at an off-centered position in said case, and said driver being located off-center.

17. A mine according to claim 1 wherein said driver comprises:

a remotely controlled receiver for receiving and decoding an encoded radio signal and for detonating said explosive charge.

18. A mine according to claim 1 wherein said blocking member comprises:

a manually operable projection extending outside said case for moving said blocking member to said retracted position in order to arm the mine.

19. A mine according to claim 18 comprising:

a domed snap ring encircling and holding said firing pin, said ring being pressure operable to reverse itself and drive said firing pin toward said detonator; and a booster aligned with said firing pin and said detonator for acting as an intermediary for sustaining the explosive chain from said detonator to said explosive charge.

* * * * *